United States Patent [19]

Gross et al.

[11] 4,290,355

[45] Sep. 22, 1981

[54] TICKET PRINTING AND ADVANCING DEVICE

[76] Inventors: Henry Gross; Samuel Gross, both of "Braewood", 45 Winnington Rd., London, England

[21] Appl. No.: 37,808

[22] Filed: May 10, 1979

[30] Foreign Application Priority Data

May 18, 1978 [GB] United Kingdom ..... 20491/78

[51] Int. Cl.[3] ..... B41J 19/76

[52] U.S. Cl. ..... 101/69; 400/574.1

[58] Field of Search ..... 101/66, 69, 288, 298, 101/316; 400/570, 574.1, 550; 235/58 P, 60 P, 433, 60 AP

[56] References Cited

U.S. PATENT DOCUMENTS

| | | | |
|---|---|---|---|
| 1,939,197 | 12/1933 | Beck | 400/574.1 X |
| 2,258,116 | 10/1941 | Klalil | 400/570 X |
| 2,285,086 | 6/1942 | Handley | 400/574.1 X |
| 2,992,719 | 7/1961 | Keller | 400/574.1 |
| 3,263,793 | 8/1966 | Brignole | 400/574.1 X |
| 3,292,762 | 12/1966 | Erickson | 400/574.1 X |
| 3,334,583 | 8/1967 | Adler | 101/66 |
| 3,433,345 | 3/1969 | Gaissert et al. | 400/574.1 |
| 4,019,617 | 4/1977 | Englund et al. | 101/66 X |

*Primary Examiner*—Edward M. Coven

*Attorney, Agent, or Firm*—James C. Wray

[57] ABSTRACT

The invention provides a device for printing and advancing tickets from a roll with various advance distances achieved with the aid of a single cam and cam follower together with an electronically operated stop which limits the movements of the follower at required moments.

5 Claims, 12 Drawing Figures

TICKET PRINTING AND ADVANCING DEVICE

This invention relates to ticket printing and advancing apparatus mainly intended for electronic cash registers and comprising an apparatus whereby a roll of paper is fed step by step and printed at each step with the value of an item e.g. an item purchased by a customer and other data. The invention will be described with reference to such electronic cash registers although the printing apparatus can be adapted to other uses. In order to allow for different spacing of the lines of printing it is necessary to advance the tickets different distances during different cycles of the apparatus. Thus in a stepwise driven apparatus, it is necessary to advance the paper several steps, e.g. ten steps to a tear off position. It is also required to print a "legend" e.g. the name of the shop, the date and a serial number. Thus on the ticket there could appear the legend as a heading followed by say one blank step, then the serial number, followed immediately by the date, then a space of say one step then the items step by step and finally the sub-total, the amount tendered and the required change when used. The paper in this example must be advanced in single steps for the items, then a distance equal to seven steps then one step and finally an intermediate distance equal to two steps. This variety of ticket advancing distances can be accomplished by complicated and costly devices but the object of the present invention is to enable these distances to be effected by comparatively simple means.

According to the invention a paper printing and advancing device having ticket drive means, a cam, means whereby the cam can be driven through single revolutions and when required through at least three revolutions continuosly and a cam follower actuated by said cam and driving said ticket drive means, is characterized by an electronically controlled stop for limiting the movement of the follower so that it advances the tickets through a minor distance and is retractable to permit movement of the follower through greater distances, said cam having a first part including a retraction part and an advance part for driving the tickets through a major distance followed by a second part which includes a further retraction part and an advance part for driving the tickets through an intermediate distance the following said three continuous revolutions operating as follows:

A. In one revolution the stop is retracted and the cam drives the tickets through the major distance in two stages corresponding to said first and second parts of the cam B. In the next revolution, the stop is retained so that the tickets are driven through the minor distance C. In the third revolution the stop is retracted between the operation of the first and second parts of the cam so that the cam drives the tickets through said intermediate distance.

By this arrangement a single cam can provide all the required ticket advance movements.

The invention will be further described by way of example with reference to the accompanying drawings wherein:

FIGS. 9 to 12 show the parts in their rest positions.

Figure 1:
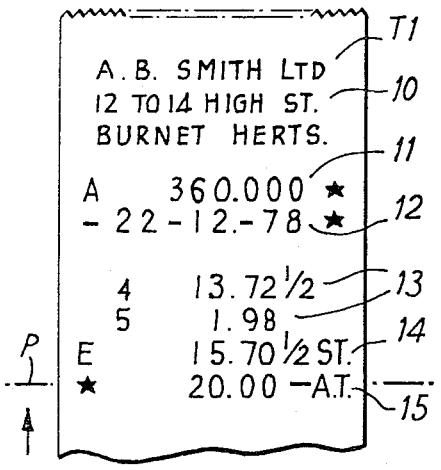
FIGS. 1 to 8 are views of a ticket showing the stages of printing and advancing.
Figure 3:
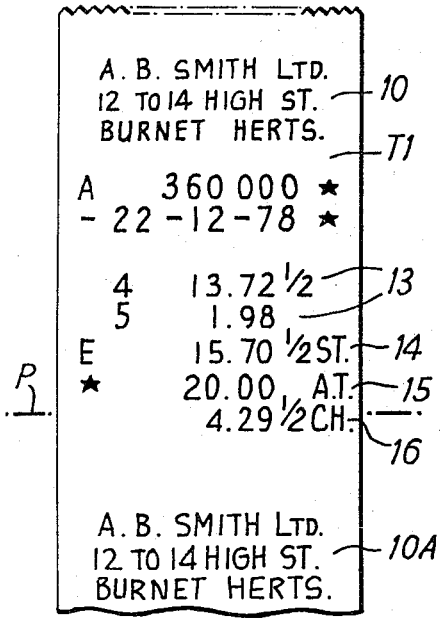
Figure 2:
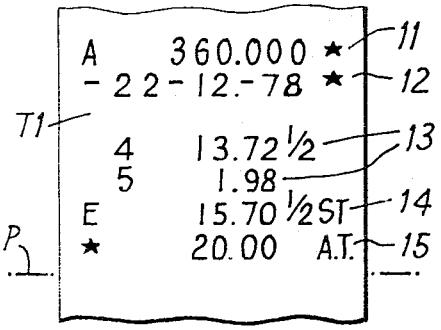
Figure 4:
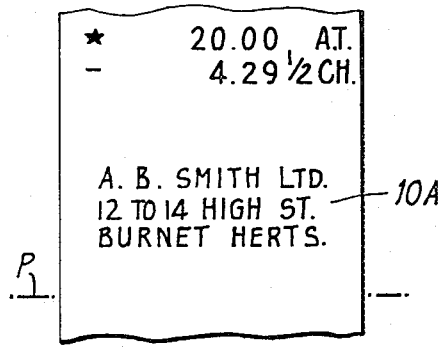
Figure 5:
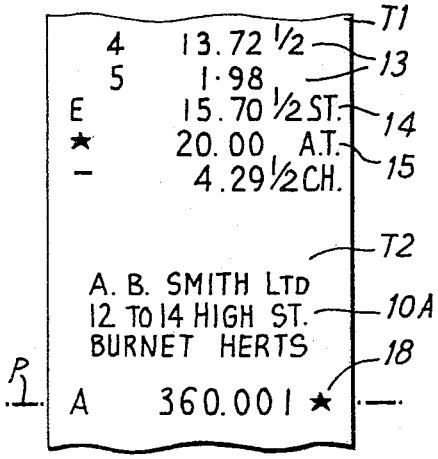
Figure 7:
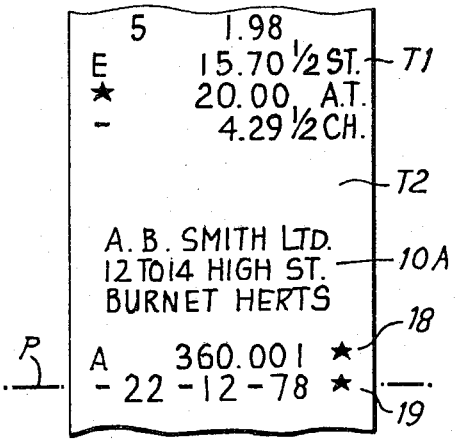
Figure 6:
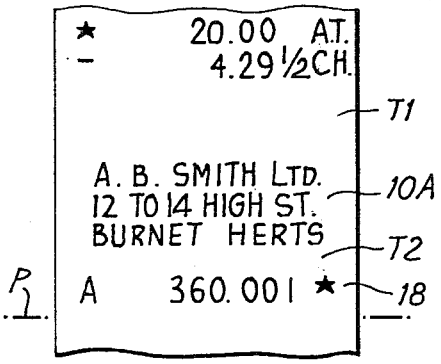
Figure 8:
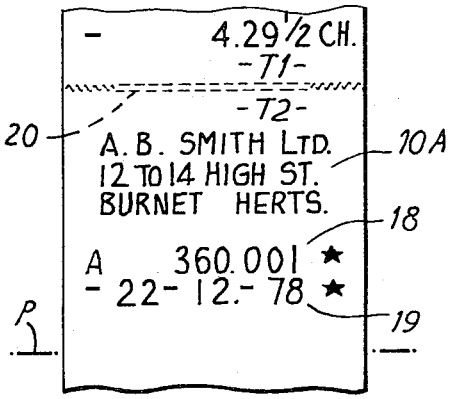
Figure 9:
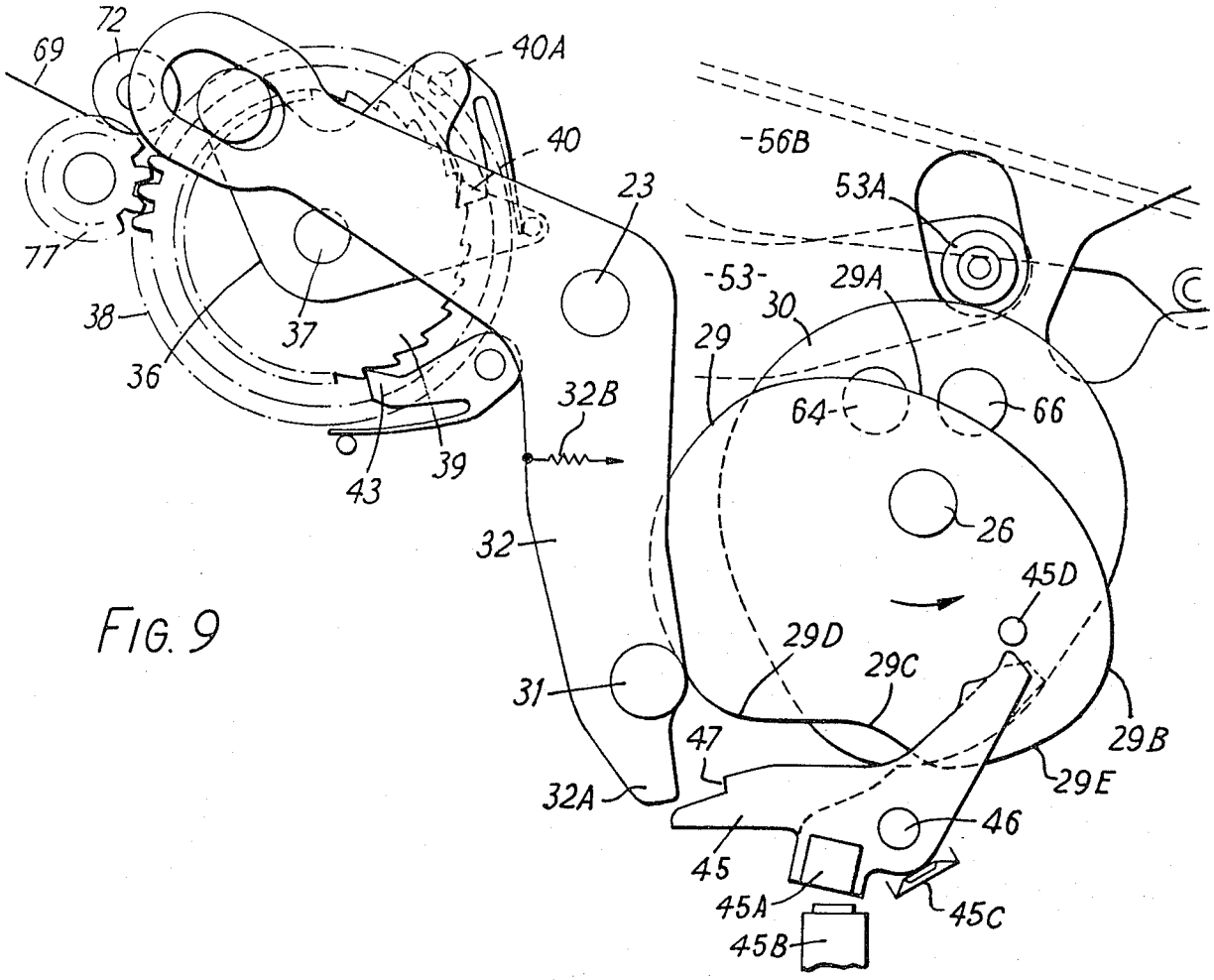
FIG. 9 is an elevational view of ticket advancing parts of an apparatus made in accordance with the invention.

FIG. 1 shows a ticket T1 which is the ticket to be issued on which there already appears the legend (name and address) at 10, a serial number at 11, and date at 12. The line P indicates the position at which items are printed. The operator actuates the various item keys and the apparatus prints the items as at 13, then presses the sub-total key to print the sub-total at 14, and the amount tendered key to print the amount tendered at 15. On each occasion the apparatus carries out one cycle of operations i.e. the main cam shaft 26 (FIGS. 9-12) of the apparatus rotates one revolution and is stopped by disengaging a clutch. Printing is effected and the ticket is advanced one step in the direction of the arrow. When the operator presses the amount tendered key the machine makes four successive cycles, the clutch being held out of action by control from the electronic means. FIG. 2 shows the ticket advanced one step in the first of the four cycles the amount tendered being printed during this cycle. FIGS. 3 and 4 show what happens in the second cycle viz. the legend is printed at 10A on the next ticket T2 and the change is printed at 16 and the ticket is then advanced seven steps in two stages (5 and 2). The printing of the change at 16 is thus the final printing for the ticket T1. FIG. 3 shows the position after printing and FIG. 4 shows the position after advancing through the two stages. In the third cycle (FIGS. 5 and 6) the serial number (or date) for the next ticket T2 is printed at 18 and the tickets T1, T2 are advanced one further step. In the fourth cycle (FIGS. 7 and 8) the date (or serial number) is printed on said next ticket T2 at 19 and the tickets are advanced two steps. This brings ticket T1 to a position where it can be torn off along the line 20 and handed to the customer leaving the ticket T2 for the next customer.

Instead of pressing the amount tendered key the operator may press the cash total key (where provided) in which case the apparatus carries out three successive cycles corresponding to FIGS. 3 to 8 i.e. omitting FIGS. 1 and 2.

Other variations are possible, for example the printing of the date and serial number may be reversed and the number of steps advanced in FIG. 4 may be varied, also the date and/or serial number may be entered at the bottom of the ticket.

The apparatus involves a set of printing wheels 25 which may be constructed and operated as described in our British Pat. Application Nos. 31994/77 and 31995/77. The apparatus has a camshaft 26 which carries a cam or may be two cams (not shown) for actuating the printing wheels. The camshaft is driven by any suitable means controlled by a one revolution clutch which can be held out of action by a pawl operated by electromagnetic means so as to make four revolutions (or cycles) continuously when required, all this being well known and therefore not described herein. The shaft 26 also carries cams 29, 30. The cam 29 is engaged by a cam follower roll 31 carried by a cam follower lever 32. The lever 32 is urged by spring 32B to hold the roll 31 against the cam and is mounted on a spindle 23 and has a pin and slot connection with a drive plate 36 that is pivotally mounted on a spindle 37. A gear wheel 38 and a ratchet wheel 39 are connected to each other and also rotatably mounted on the spindle 37. The plate 36 carries a pivoted drive pawl 40 pivoted at 40A which engages the ratchet wheel 39. A non-return pawl 43 also engages the ratchet wheel.

A pawl 45 pivotally mounted on a spindle 46 has a stop shoulder 47 engageable by the nose 32A of the lever 32 so that for advancing the paper one pitch for each revolution of the shaft 26 the movement of the lever 32 is limited by the stop shoulder 47. The pawl 45 is made of plastics material and carries a steel block 45A which cooperates with an electromagnetic device 45B whereby the pawl can be withdrawn at precisely determined angular displacements of the cam 29. A spring 45C acts on the pawl 45 to hold it in any position to which it is moved. The pawl is moved back to its normal position by a pin 45D on the cam 29. The device 45B is pulsed at required moments from an electronic logic the specific construction of which forms no part of this invention.

Figure 11:
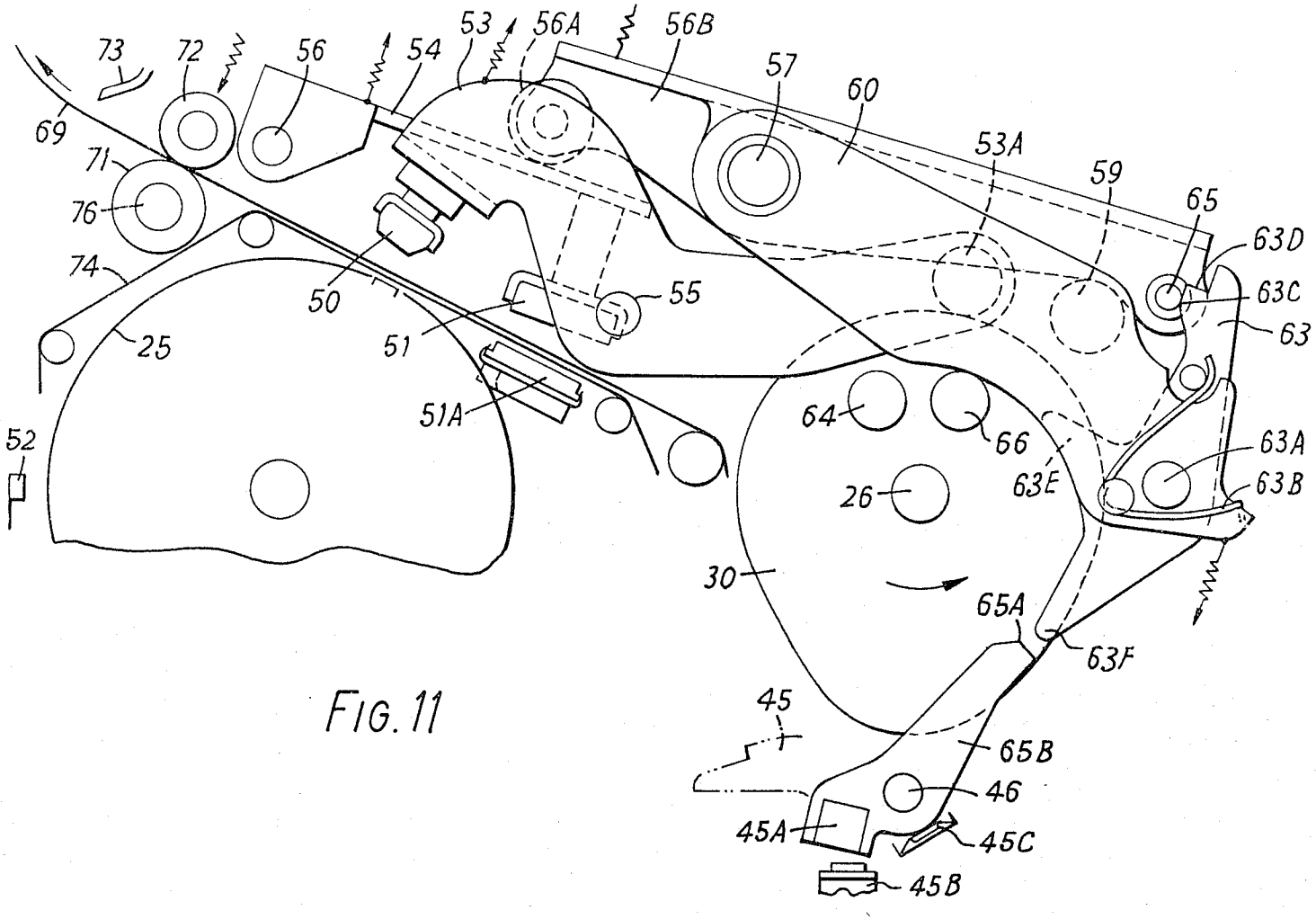
FIG. 11 is an elevational view of ticket printing parts of the apparatus.
Figure 12:
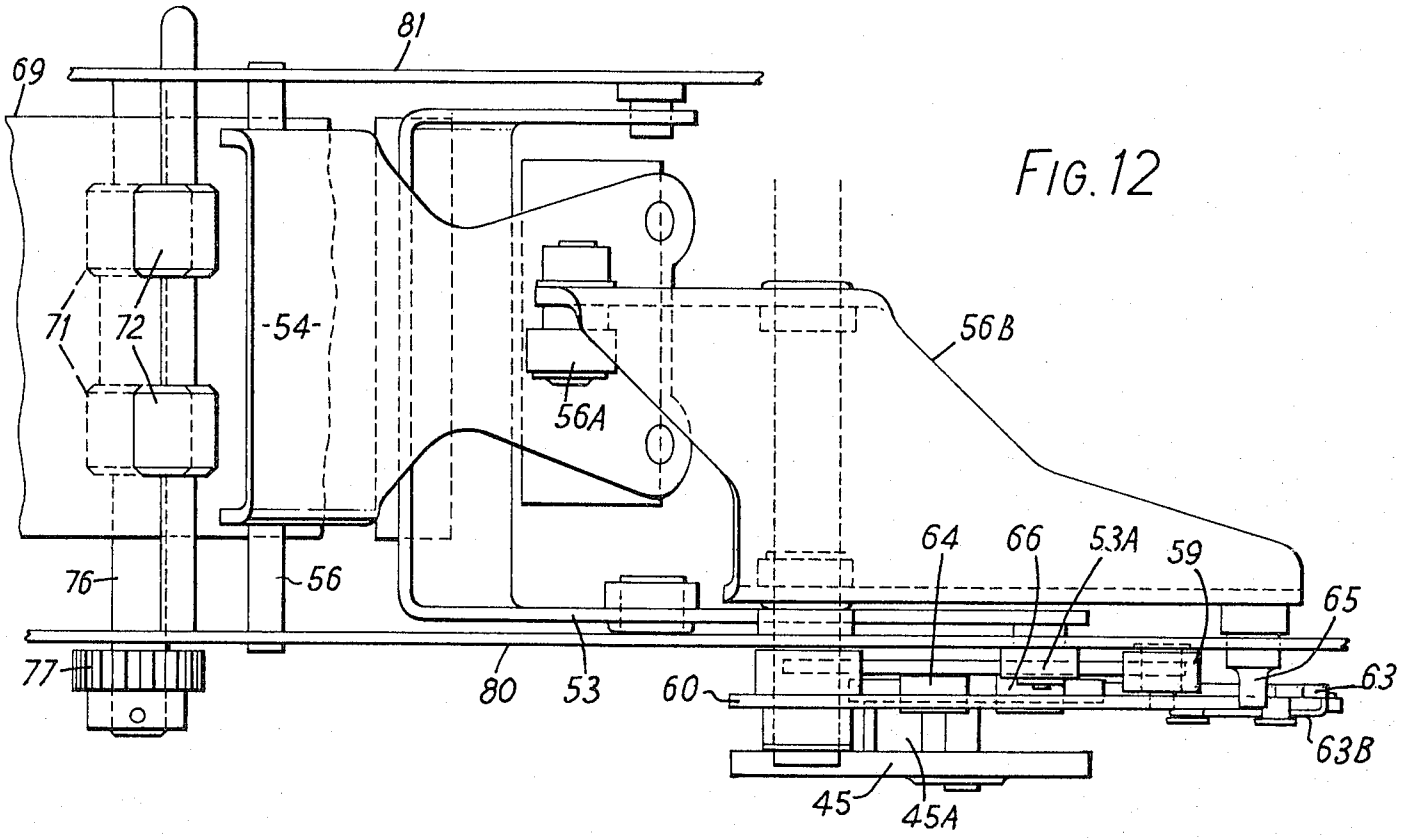
FIG. 12 is a plan view of the ticket printing parts of FIG. 11.

The printing mechanism shown in FIGS. 11 and 12 comprises a printing pad 50 which cooperates with the printing wheels 25 to print items such as date, serial number, sub-totals, amount tendered and change and a printing pad 51 which cooperates with a legend printing block 51A to print the legend (name of the shop etc.). There is also an audit roll printing pad 52 the operation of which does not concern the present invention.

The pads 50, 51 are carried respectively by arms 53, 54 pivoted at 55, 56. The lever 53 carries a cam follower roll 53A which engages the cam 30.

The lever 54 is acted on by a roll 56A carried by a lever 56B mounted on a spindle 57. Also mounted on the spindle 57 is a lever 60 which has a roller 59 engageable by the cam 30. The lever 60 also carries a pawl 63 pivoted at 63A and urged by a spring 63B so that in the rest position an abutment surface 63A engages a pin 65 on the lever 56B. The pawl 63 has a notch 63D which can engage below the pin 65 to effect printing.

The pawl 63 has a projection 63E which can be engaged by a roller 64 on the cam 30 for restoring the pawl to its rest position. The pawl 63 also has a nose 63F which engages the end 65A of a pawl 65B to prevent the notch 63D from moving under the pin 65 when printing is not required. The pawl 65B is fixed to or integral with the pawl 45 so that it is actuated by the same electromagnet 45B.

The cam 30 carries the roller 64 and also a roller 66. These rolls can engage the lever 60 to keep it in its raised position when required.

A roll of paper 69 for the tickets enters between feed rollers 71, 72. A tear off blade is shown at 73. A printing ribbon is shown at 74. The rollers 71 are carried by a spindle 76 which also carries a pinion 77 which engages the gearwheel 38 so as to be driven step by step according to the movements of the ratchet wheel 39 by the pawl.

Figure 10:
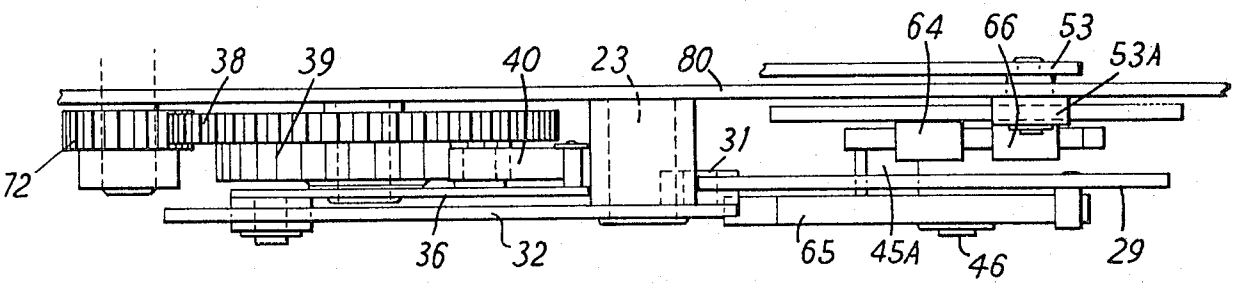
FIG. 10 is a plan view of the parts shown in FIG. 9.

The various spindles and pivots are carried by frame plates 80, 81 (FIGS. 10 and 12).

The cam 29 has a first part which includes a follower retraction portion 29A and a follower drive portion 29B. The cam also has a second part which also includes a follower retraction recess 29C and a follower advance portion 29D. The two parts together provide for a major drive distance equivalent to seven steps i.e. in two stages 5 and 2 within the one revolution. The second part of the cam 29C, 29D can effect drive through two steps only in another revolution when the stop pawl 45 remains in position just prior to 29C, 29D operating on the follower.

Between the two parts 29A, 29B and 29C, 29D, the cam has a concentric part 29E which facilitates retraction of the stop pawl 45.

The operation of the apparatus is as follows:

On pressing an item key, the electromagnet 45B is not energized so that the pawl 63 engages at 63F with 65A. The notch 63D therefore cannot engage below the pin 65 so that the levers 60, 53 cannot be driven and the legend cannot be printed. However the cam 30 actuates 53A, 53, 50 to print the appropriate figures on the print line P shown in FIGS. 1 to 8. The cam 29 actuates lever 32 to cause the pawl 40 to run back over the teeth of ratchet 39 and then drives forward one step limited by engagement of nose 32A with stop shoulder 47 so as to rotate wheel 38 and pinion 77 to advance the ticket paper one step. The mainshaft 26 is then stopped by disengagement of the clutch.

When an amount tendered key is pressed the shaft 26 makes four successive revolutions to effect four cycles of the apparatus. In the first cycle "amount tendered" is printed and the tickets are advanced one step as shown in FIGS. 1 and 2 and as described above.

In the second cycle, the electromagnet 43B is energized at the beginning of the cycle so that stop shoulder 47 is moved out of the path of the nose 32A of lever 32 and the end 65A of pawl 65B is moved out of the path of the nose 63F of pawl 63. The rollers 64, 66 move away from the lever 60 which drops to bring the notch 63D below the pin 65. The cam 30 drives the roller 59 and lever 60 up and the pawl 63 drives the pin 65 and lever 56B up so as to press the lever 54 down and print the legend on the next i.e. penultimate ticket T2. At about the same time the cam 30 leaves roller 59 and engages the roller 53A and actuates the lever 53 to print the change on ticket T1. Also the cam 29 allows the roller 31 to move to the right (FIG. 9) so that the pawl 40 runs back over the ratchet 39 to "collect" six teeth as the roller 31 reaches part 29A of the cam then allows the lever 32 to drive five teeth and thus advance the ticket a distance equal to five steps. It is the part 29B of cam 29 which drives the lever 32 so that the pawl 40 drives the ratchet 39 and pinion 77 to advance the ticket the aforesaid the distance equivalent to five steps. The cam position at 29C then allows the lever 32 to move back to "collect" one more tooth of the ratchet 39. The cam 29 finally at part 29D drives the lever 32 to advance the tickets two more steps. As the cam 29 returns to its rest position the pawls 45, 65B are moved back to normal position by pin 45D on cam 29. The roller 64 also moves pawl 63 back to its rest position by engagement with part 63E. The final ticket T1 is then as shown in FIG. 4.

The third cycle then commences. The cam 30 operates the lever 53 to print the serial number at 18. The electromagnet 45B is not energized. The cam 29 moves the lever 32 to cause the pawl 40 to collect one tooth and then to drive the tickets one step to the position shown at FIG. 6.

In the fourth cycle the cam 30 moves the lever 53 to print the date at 19 and the cam 29 actuates the lever 32 to collect one tooth of the ratchet wheel. The electromagnet 45B is then energized at position 29E (which is a concentric part of the cam) and the cam 29 (at 29C) then actuates lever 32 to collect one more pitch and then drives the lever 32 (at 29D) to advance the tickets two steps to the position shown in FIG. 8 whereupon the ticket T1 can be torn off at 20 and given to the customer. Although the electromagnet 45B has been energized the legend will not be printed because the roller 64 at the appropriate time engages the lever 60 and prevents the notch 63D from falling under the pin 65.

If the operator presses the cash total key (where provided) instead of the amount tendered key the apparatus will make only three cycles corresponding to the second, third and fourth cycles described above.

It will be seen that by providing the single ticket advance control cam 29 with a suitable recessive part in conjunction with the follower stop 45 the apparatus can make three different distances of advance with different numbers of steps e.g. 1, 2 and 7. Thus the recessive part 29C, 29D in the cam 29 provides the intermediate range e.g. 2 steps in the fourth of the four continuous cycles. This part makes it necessary to effect the major range in two steps e.g. 5 and 2 in the second cycle while the follower stop 45 enables the same cam to move the follower for the minor range e.g. 1 step, in the first cycle as well as for printing the individual items.

If desired, the levers 53 and 60 may be operated by two separate cams instead of the single cam 30.

We claim:

1. A ticket printing and advancing device having ticket drive means, a cam, means whereby the cam can be driven through single revolutions and when required through at least three revolutions continuously, a cam follower means actuated by said cam for driving said ticket drive means, characterized by an electronically controlled stop for limiting the movement of the follower, so that the follower advances the tickets through a minor distance, stop retracting means for retracting said stop and stop restoring means to restore the stop to its follower limiting positions, said cam having a first part which includes a follower retraction part and a follower drive part means for driving the tickets through a major distance followed by a second part which includes a further follower retraction part and a further follower drive part means for driving the tickets through an intermediate distance;

said stop retracting means retracting the stop in the first of said revolutions while the cam drives the tickets through the major distance in two stages corresponding to said first and second parts of the cam;

said stop restoring means restoring the stop in the next of said revolutions, so that the tickets are driven through the minor distance;

said stop retracting means retracting the stop in the third of said revolutions between the operation of the first and second parts of the cam so that the cam drives the tickets through said intermediate distance.

2. A device as claimed in claim 6 wherein the cam has a concentric portion to facilitate removal of the stop while the follower engages this concentric portion.

3. A ticket printing and advancing device as claimed in claim 1 or 2 hwerein said stop is a pawl operated by electromagnetic means, and having first printing means to print a legend, second printing means to print items, a second cam means for driving said first and second printing means, a drive device between the cam means and the first printing means, and a second pawl means connected to the first pawl to hold said drive device out of action until it is actuated by said electromagnetic means.

4. A ticket printing and advancing device as claimed in claim 1 or 2 further comprising means for printing in the first of said three revolutions, a legend on a penultimate ticket and change on a final ticket as the tickets are advanced through the major distance, means for printing in the second revolution a serial number on the penultimate ticket as the tickets are advanced through the minor distance and means for printing in the third revolution the date on the penultimate ticket as the tickets are advanced through the intermediate distance.

5. A device as claimed in claim 4 further comprising an amount tendered key, means to actuate the cam to make four continuous revolutions when the amount tendered key is actuated, means for printing in a preliminary revolution the amount tendered, means for advancing the tickets through the minor distance in the preliminary revolution followed by the three revolutions.

* * * * *